US012507852B2

(12) United States Patent
Deng et al.

(10) Patent No.: US 12,507,852 B2
(45) Date of Patent: Dec. 30, 2025

(54) CLEANING BASE STATION AND CLEANING SYSTEM

(71) Applicant: SHENZHEN SILVER STAR INTELLIGENT GROUP CO., LTD., Shenzhen (CN)

(72) Inventors: Wenhai Deng, Shenzhen (CN); Kunjun Deng, Shenzhen (CN); Yongchuan Li, Shenzhen (CN); Linlin Zhou, Shenzhen (CN); Jie Liang, Shenzhen (CN); Wenbin Yong, Shenzhen (CN); Qingshuang Lv, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 307 days.

(21) Appl. No.: 17/899,689

(22) Filed: Aug. 31, 2022

(65) Prior Publication Data

US 2023/0148816 A1 May 18, 2023

(30) Foreign Application Priority Data

Nov. 13, 2021 (CN) ..... 202111343402.8

(51) Int. Cl.
*A47L 9/28* (2006.01)

(52) U.S. Cl.
CPC ..... *A47L 9/2873* (2013.01); *A47L 9/2847* (2013.01); *A47L 2201/028* (2013.01)

(58) Field of Classification Search
CPC ..... A47L 9/2873; A47L 2201/02; A47L 2201/024; A47L 2201/026;
(Continued)

(56) References Cited

U.S. PATENT DOCUMENTS 5,735,017 A * 4/1998 Barnes ..... A47L 11/4027 15/328
2022/0346619 A1* 11/2022 Huang ..... A47L 11/4016

FOREIGN PATENT DOCUMENTS

CN 110464265 A * 11/2019 ..... A47L 11/4091
CN 111938526 A * 11/2020 ..... A47L 11/283
(Continued)

OTHER PUBLICATIONS

CN-113413101 Translated Description (Year: 2021).*
(Continued)

*Primary Examiner* — Tom Rodgers
(74) *Attorney, Agent, or Firm* — IPro, PLLC; Na Xu

(57) ABSTRACT

A cleaning base station for a cleaning robot is disclosed. The cleaning base station includes a base station body, a cleaning structure, a first liquid storage structure and a second liquid storage structure. The base station body defines a cleaning space where the cleaning robot is capable of being parked, and the base station body includes a liquid applicating port on an upper side of the cleaning space and a sewage suction outlet on a lower side of the cleaning space. The cleaning structure is installed on a lower side of the cleaning space and is configured to clean a cleaning member of the cleaning robot. The first liquid storage structure is in communication with the liquid applicating port, and the second liquid storage structure is in communication with the sewage suction outlet.

17 Claims, 10 Drawing Sheets

(58) Field of Classification Search
CPC .. A47L 2201/028; A47L 11/03; A47L 11/408; A47L 11/4083; A47L 11/4088; A47L 11/4013; A47L 11/4016; A47L 11/4022
USPC ..... 134/94.1, 99.1, 104.2, 184, 186
See application file for complete search history.

(56) References Cited

FOREIGN PATENT DOCUMENTS

| | | | | | |
|---|---|---|---|---|---|
| CN | 111973046 | A | * | 11/2020 | ..... A47L 1/02 |
| CN | 112773263 | A | * | 5/2021 | ..... A47L 11/24 |
| CN | 113017502 | A | | 6/2021 | |
| CN | 113180559 | A | | 7/2021 | |
| CN | 113413096 | A | * | 9/2021 | ..... A47L 11/24 |
| CN | 113413101 | A | * | 9/2021 | ..... A47L 11/4025 |
| CN | 216535190 | U | | 5/2022 | |
| DE | 202016104067 | U1 | * | 12/2017 | ..... A47L 11/40 |
| WO | 2018108144 | A1 | | 6/2018 | |

OTHER PUBLICATIONS

CN-110464265 Translated Description (Year: 2019).*
CN-112773263 Translated Description (Year: 2021).*
CN-113413096 Translated Description (Year: 2021).*
DE-202016104067 Translated Description (Year: 2017).*
CN_111973046 Translated Description (Year: 2020).*
CN-111938526-A Translated Description (Year: 2020).*

* cited by examiner

CLEANING BASE STATION AND CLEANING SYSTEM

CROSS-REFERENCE TO RELATED APPLICATIONS

The present disclosure claims priority of Chinese Patent Application No. 202111343402.8, filed on Nov. 13, 2021, titled "cleaning base station and cleaning system", the contents of which are incorporated herein by reference.

TECHNICAL FIELD

The present disclosure relates to the technical field of cleaning equipments, and in particular, relates to a cleaning base station and a cleaning system.

BACKGROUND

A cleaning base station is a kind of equipment used in combination with a cleaning robot, and it may be used to clean a cleaning member (such as a roller brush, a mop, etc.) of the cleaning robot. The current cleaning base station is usually provided with a cleaning sink at the cleaning space of the cleaning robot. The water injection nozzle and the cleaning structure of the cleaning base station are both arranged in the cleaning sink, and the water injection nozzle sprays water upwards to wet the cleaning member of the cleaning robot, and the cleaning structure moves relative to the cleaning member of the cleaning robot, so as to clean the cleaning member of the cleaning robot.

However, when the cleaning base station cleans the cleaning member of the cleaning robot, the water attached to the cleaning member of the cleaning robot drops into the cleaning sink under its own gravity, and thus the sewage will easily flow back into the water injection nozzle. In addition, the sewage in the cleaning sink has not been discharged in time, which leads to bacteria breeding in the cleaning sink.

SUMMARY

An embodiment of the present disclosure provides a cleaning base station for a cleaning robot, the cleaning base station includes a base station body, a cleaning structure, a first liquid storage structure and a second liquid storage structure. The base station body defines a cleaning space where the cleaning robot is capable of being parked, and the base station body includes a liquid applicating port on an upper side of the cleaning space and a sewage suction outlet on a lower side of the cleaning space. The cleaning structure is installed on a lower side of the cleaning space and is configured to clean a cleaning member of the cleaning robot. The first liquid storage structure is in communication with the liquid applicating port, and the second liquid storage structure is in communication with the sewage suction outlet.

Another embodiment of the present disclosure provides a cleaning system, the cleaning system includes a cleaning robot and the above-mentioned cleaning base station, the cleaning robot is capable of docking with the cleaning base station, and the cleaning base station is configured to maintain the cleaning robot.

BRIEF DESCRIPTION OF THE DRAWINGS

In order to explain the embodiments of the present disclosure or technical solutions in the prior arts more clearly, attached drawings required in the description of the embodiments or the prior arts will be briefly introduced below. Obviously, the attached drawings in the following description are only some embodiments of the present disclosure. For those of ordinary skill in the art, other drawings can be obtained according to the structures shown in these attached drawings without creative labor.

Implementation of objectives, functional features and advantages of the present disclosure will be further described in combination with embodiments and with reference to attached drawings.

DETAILED DESCRIPTION

Hereinafter, technical solutions in the embodiments of the present disclosure will be described clearly and completely with reference to the attached drawings in the embodiments of the present disclosure. Obviously, the embodiments described are only part but not all of the embodiments of the present disclosure. Based on the embodiments of the present disclosure, all other embodiments obtained by those of ordinary skill in the art without creative labor belong to the protective scope claimed in the present disclosure.

It shall be noted that, all directional indicators (such as up, down, left, right, front, back and so on) in the embodiment of the present disclosure are only used to explain relative position relationships and movement situations among components in a specific posture (as shown in the attached drawing). If the specific posture changes, the directional indicators will change accordingly.

In addition, in the present disclosure, descriptions such as "first", "second" or the like are only used for descriptive purposes, and should not be understood as indicating or implying the relative importance thereof or implicitly indicating the number of indicated technical features. Therefore, features defined with "first" and "second" may explicitly or implicitly include at least one of the features. In addition, technical solutions among the embodiments may be combined with each other on the basis that they can be realized by those of ordinary skill in the art. When the combination of the technical solutions is contradictory or impossible to be realized, it should be considered that such combination of the technical solutions does not exist, and it is not within the protective scope claimed in the present disclosure.

The present disclosure provides a cleaning base station, which is used in combination with a cleaning robot. The cleaning base station can not only be used to clean a cleaning member (a mop, a roller brush, etc.) on the cleaning robot, but also charge the robot, and perform other tasks on the cleaning robot, which are not listed herein.

Figure 1:
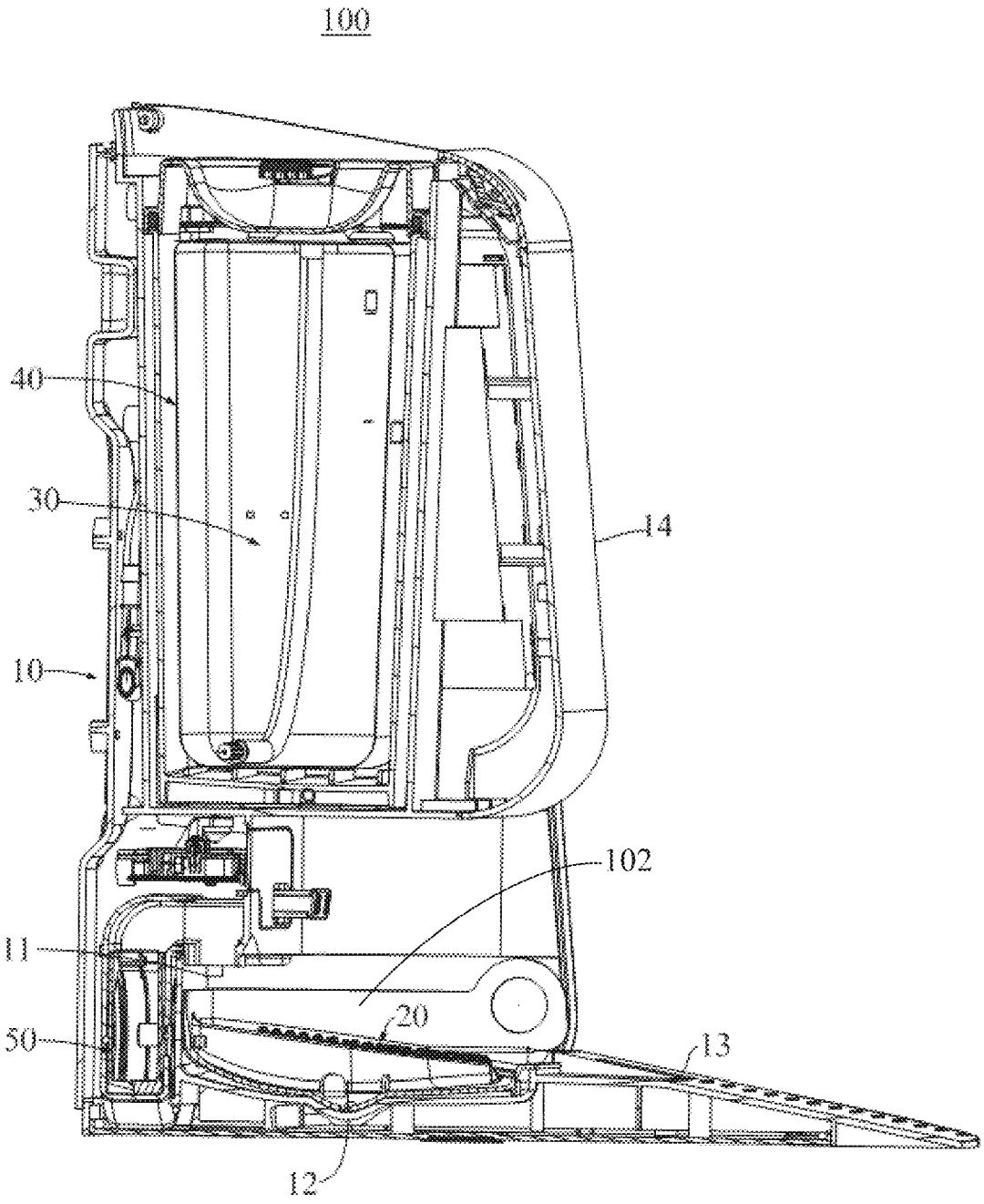
FIG. 1 is a cross-sectional view of a cleaning base station according to an embodiment of the present disclosure.
Figure 2:
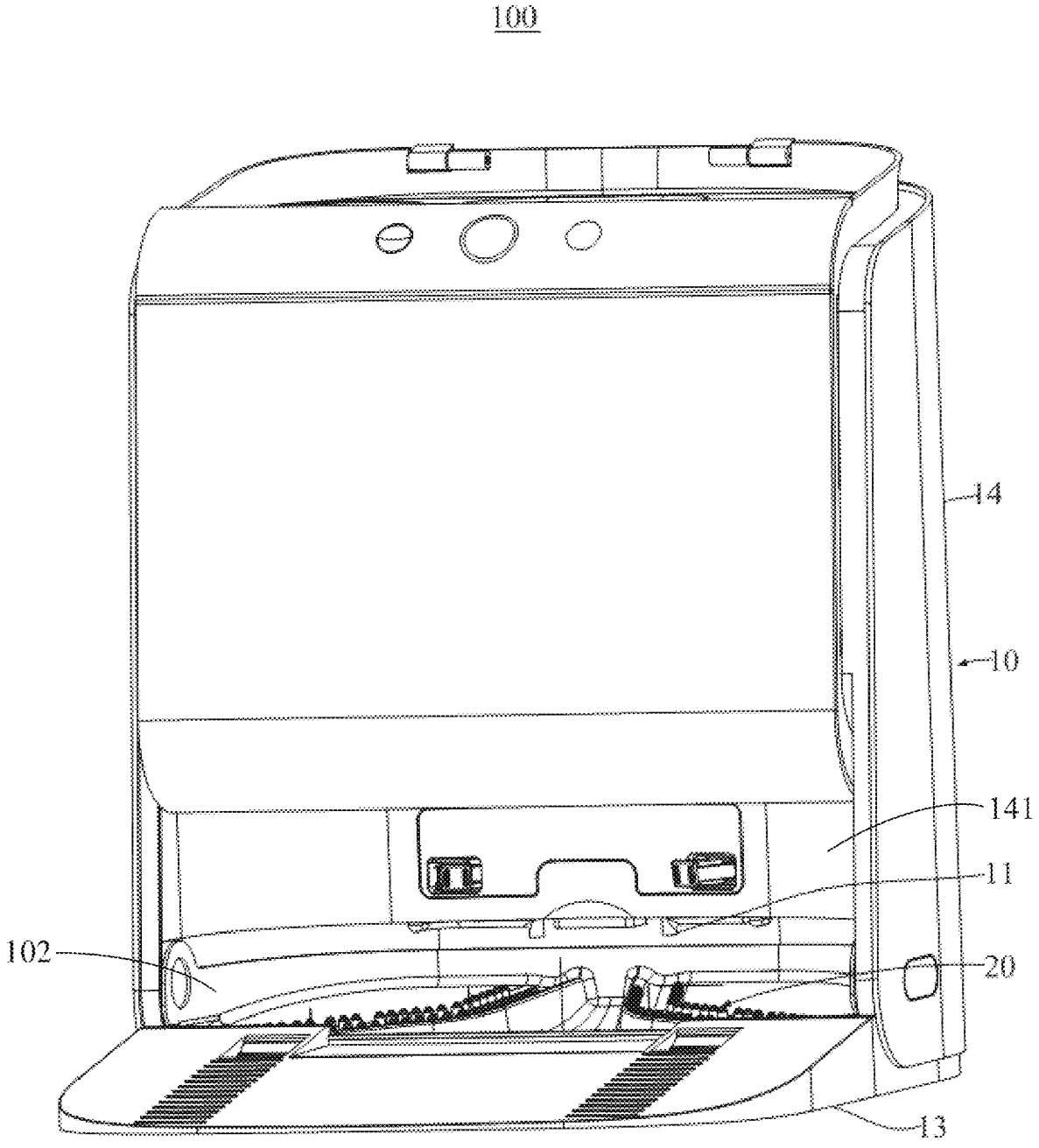
FIG. 2 is a schematic structural view of the cleaning base station in FIG. 1 from another perspective.

Referring to FIG. 1 and FIG. 2, an embodiment of the cleaning base station 100 includes a base station body 10, a cleaning structure 20, a first liquid storage structure 30, and a second liquid storage structure 40.

The base station body 10 may be formed in many shapes. For example, the base station body 10 may be cylindrical, L-shaped, C-shaped or formed in other shapes, and this is not specifically limited herein.

The base station body 10 defines a cleaning space 102 where the cleaning robot can be parked. The cleaning space 102 refers to a space position, and there are many types of cleaning space. For example, the cleaning space 102 may be open, semi-open or closed, and the type of the cleaning space 102 is not specifically limited herein.

The shape of the base station body 10 may also be set according to the type of the cleaning space 102. For example, when the cleaning space 102 is open, the base station body 10 may be L-shaped, and in this case, the bottom part of the cleaning base station 100 may define the cleaning space 102 where the cleaning robot can be parked.

As another example, when the cleaning space 102 is semi-open, the base station body 10 may be C-shaped. In this case, the concave part of the cleaning base station 100 at the middle position may define the cleaning space 102, or the side surface of the base station body 10 is concavely provided with a groove structure to form the cleaning space 102.

As yet another example, when the cleaning space 102 is closed, the base station body 10 may form the cleaning space 102 by setting a cavity structure with a door that can be opened or closed, or the base station body 10 may form the cleaning space 102 by setting a structure capable of covering the cleaning robot.

The base station body 10 includes a liquid applicating port 11 on an upper side of the cleaning space 102. The liquid applicating port 11 may be formed by the liquid outlet end of a nozzle or formed by a hole structure defined on the base station body 10, and the liquid applicating port 11 may also be formed by a tubular structure enclosed by a plurality of structures. The way in which the liquid applicating port 11 is formed is not specifically limited herein.

The base station body 10 includes a sewage suction outlet 12 on a lower side of the cleaning space 102. The sewage suction outlet 12 may be formed by the liquid inlet end of a sewage pipe, or formed by the opening of a pipe structure provided on the base station body 10. The sewage suction outlet 12 may also be formed by other ways, which are not listed herein.

Both the first liquid storage structure 30 and the second liquid storage structure 40 are containers capable of storing liquid. The first liquid storage structure 30 and the second liquid storage structure 40 may be formed by cavity structures on the base station body 10, and the first liquid storage structure 30 and the second liquid storage structure 40 may also be containers independent from the base station body 10. The types of the first liquid storage structure 30 and the second liquid storage structure 40 are not specifically limited herein.

The first liquid storage structure 30 is in communication with the liquid applicating port 11 through a pipeline, and the flowing power for the liquid in the first liquid storage structure 30 to flow towards the liquid applicating port 11 is further related to the relative position relationship between the first liquid storage structure 30 and the liquid applicating port 11. If the first liquid storage structure 30 is located above the liquid applicating port 11, the liquid in the first liquid storage structure 30 may flow to the liquid applicating port 11 by its own gravity. If the first liquid storage structure 30 is flush with the liquid applicating port 11 or located below the liquid applicating port 11, then it is necessary to connect a pump in series on the pipeline connecting the first liquid storage structure 30 and the liquid applicating port 11 or apply other power to drive the liquid in the first liquid storage structure 30 to flow.

The second liquid storage structure 40 is in communication with the sewage suction outlet 12 through a pipeline, and the flowing power for the liquid at the sewage suction outlet 12 to flow towards the second liquid storage structure 40 is further related to the relative position relationship between the second liquid storage structure 40 and the sewage suction outlet 12. If the second liquid storage structure 40 is located below the sewage suction outlet 12, the liquid at the sewage suction outlet 12 may flow to the second liquid storage structure 40 by its own gravity. If the sewage suction outlet 12 is flush with the second liquid storage structure 40 or located below the second liquid storage structure 40, then it is necessary to connect a pump in series on the pipeline connecting the second liquid storage structure 40 and the sewage suction outlet 12 or apply other power to drive the liquid in the second liquid storage structure 40 to flow.

The cleaning structure 20 is configured to clean the cleaning member of the cleaning robot. The cleaning structure 20 may include two categories, i.e., a category which contacts with the cleaning member of the cleaning robot, and another category which does not contact with the cleaning member of the cleaning robot. The cleaning structures 20 belonging to the category that contacts with the cleaning member of the cleaning robot may be scrapers, scrubbers, roller brushes and other structural components, while the cleaning structures 20 belonging to the category that does not contact with the cleaning member of the cleaning robot may be impellers or ultrasonic generator and other structural components.

The cleaning structure 20 belonging to the category that contacts with the cleaning member of the cleaning robot may be fixedly installed on the base station body 10 or movably installed on the base station body 10. If the cleaning structure 20 belonging to the category that contacts with the cleaning member of the cleaning robot is fixedly installed, then the cleaning member of the cleaning robot needs to rotate by itself during cleaning. If the cleaning structure 20 belonging to the category that contacts the cleaning member of the cleaning robot is movably installed, the cleaning member of the cleaning robot may be cleaned simply by driving the cleaning structure 20 to move.

The cleaning structure 20 is installed on a lower side of the cleaning space 102, and the cleaning structure 20 may be directly fixed on the base station body 10. At this time, the cleaning structure 20 may be fixed on the base station body 10 by screwing, welding, bonding or the like. The cleaning structure 20 may also be indirectly installed on the base station body 10, and in this case, the cleaning structure 20 may be fixedly installed on the base station body 10 through a bracket, and the specific installation way of the cleaning structure 20 is not limited herein.

When the cleaning base station 100 is cleaning the cleaning member of the cleaning robot, the cleaning liquid in the first liquid storage structure 30 flows down on the lower side of the cleaning space 102 through the liquid applicating port 11 to wet the cleaning member of the cleaning robot, the cleaning structure 20 cleans the cleaning member of the cleaning robot to remove the dust, silt and other stains on the cleaning member of the cleaning robot, and the sewage dripping from the cleaning member of the cleaning robot enters the second liquid storage structure 40 through the sewage suction outlet 12. With this arrangement, the sewage produced from the process of cleaning the cleaning member of the cleaning robot may be pumped out in time, thereby preventing the sewage from being stored at the cleaning space 102, and further avoiding the problem of bacteria breeding in the cleaning space 102 of the cleaning base station 100.

In order to ensure the integrity of the overall structure of the cleaning base station 100, in some embodiments of the present disclosure, referring to FIG. 1 and FIG. 2, the base station body 10 includes a chassis assembly 13 and a liquid tank bracket 14, the liquid tank bracket 14 is installed above the chassis assembly 13. The liquid tank bracket 14 and the chassis assembly 13 cooperatively define the cleaning space 102. At this time, the liquid tank bracket 14 and the chassis assembly 13 may form an L-shaped configuration or a C-shaped configuration, and this is not specifically limited herein.

Figure 3:
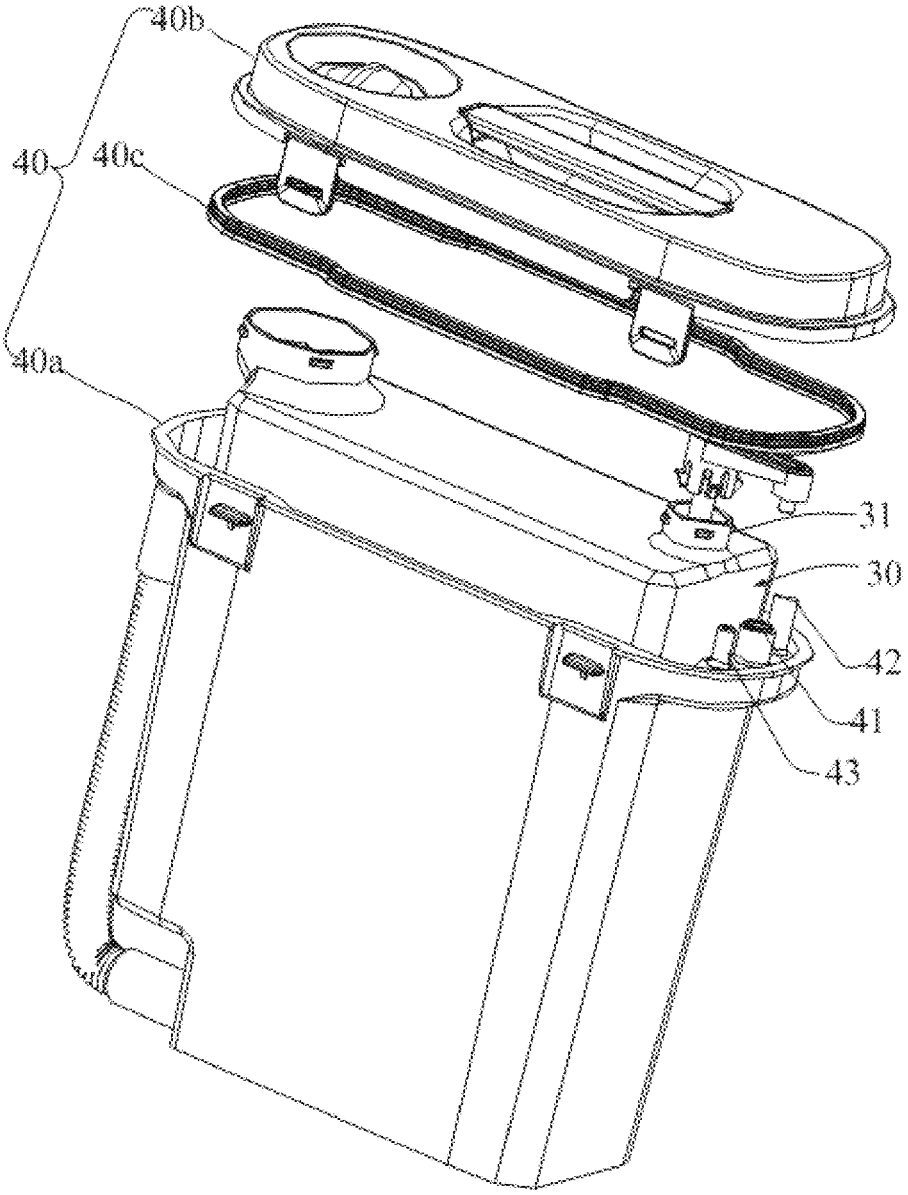
FIG. 3 is an exploded schematic view of a first liquid storage structure and a second liquid storage structure in FIG. 1.

Referring to FIG. 3 together, the liquid tank bracket 14 defines an accommodating cavity 141 configured to accommodate the first liquid storage structure 30 and the second liquid storage structure 40. It shall be noted that, the accommodating cavity 141 may be provided with only one accommodating area, such that the first liquid storage structure 30 and the second liquid storage structure 40 may be installed together, or the accommodating cavity 141 may define two accommodating areas spaced apart from each other, such that the first liquid storage structure 30 and the second liquid storage structure 40 may be installed separately.

The first liquid storage structure 30 and the second liquid storage structure 40 are both installed in the liquid tank bracket 14, which not only facilitates the firmly installation of the first liquid storage structure 30 and the second liquid storage structure 40, but also improves the structural integrity of the cleaning base station 100. In addition, the base station body 10 includes the chassis assembly 13 and the liquid tank bracket 14, such that the area occupied by the whole base station body 10 in the horizontal direction may be reduced, and the cleaning base station 100 may be conveniently placed.

Furthermore, the first liquid storage structure 30 is configured to storage cleaning liquid and the second liquid storage structure 40 is configured to storage sewage. When the cleaning member of the cleaning robot is cleaned, the amount of the cleaning liquid in the first liquid storage structure 30 becomes less and less during use, and the amount of the sewage in the second liquid storage structure 40 becomes more and more. In view of this, the first liquid storage structure 30 can be a flexible liquid storage bag, and meanwhile, the first liquid storage structure 30 is installed inside the second liquid storage structure 40.

Specifically, the second liquid storage structure 40 includes a tank body 40*a*, a box cover 40*b* and a sealing ring 40*c*. The box cover 40*b* is configured to cover the opening of the tank body 40*a*, and the tank body 40*a* and the box cover 40*b* are hermetically connected by the sealing ring 40*c*. The first liquid storage structure 30 may be fixedly connected with the tank body 40*a*, or the first liquid storage structure 30 may be fixedly connected with the box cover 40*b*, and this is not specifically limited herein.

In this way, when the second liquid storage structure 40 is not filled with sewage, the first liquid storage structure 30 may be fully filled with cleaning liquid, and after all the cleaning liquid in the first liquid storage structure 30 is discharged, the second liquid storage structure 40 may be fully filled with sewage. With this arrangement, not only may more cleaning water be filled without changing the volume of the accommodating cavity 141 of the liquid tank bracket 14, but also the user can confirm that the second liquid storage structure 40 is fully filled with sewage when no cleaning liquid is discharged from the liquid applicating port 11, such that it is convenient for the user to perform sewage disposal in time.

Figure 4:
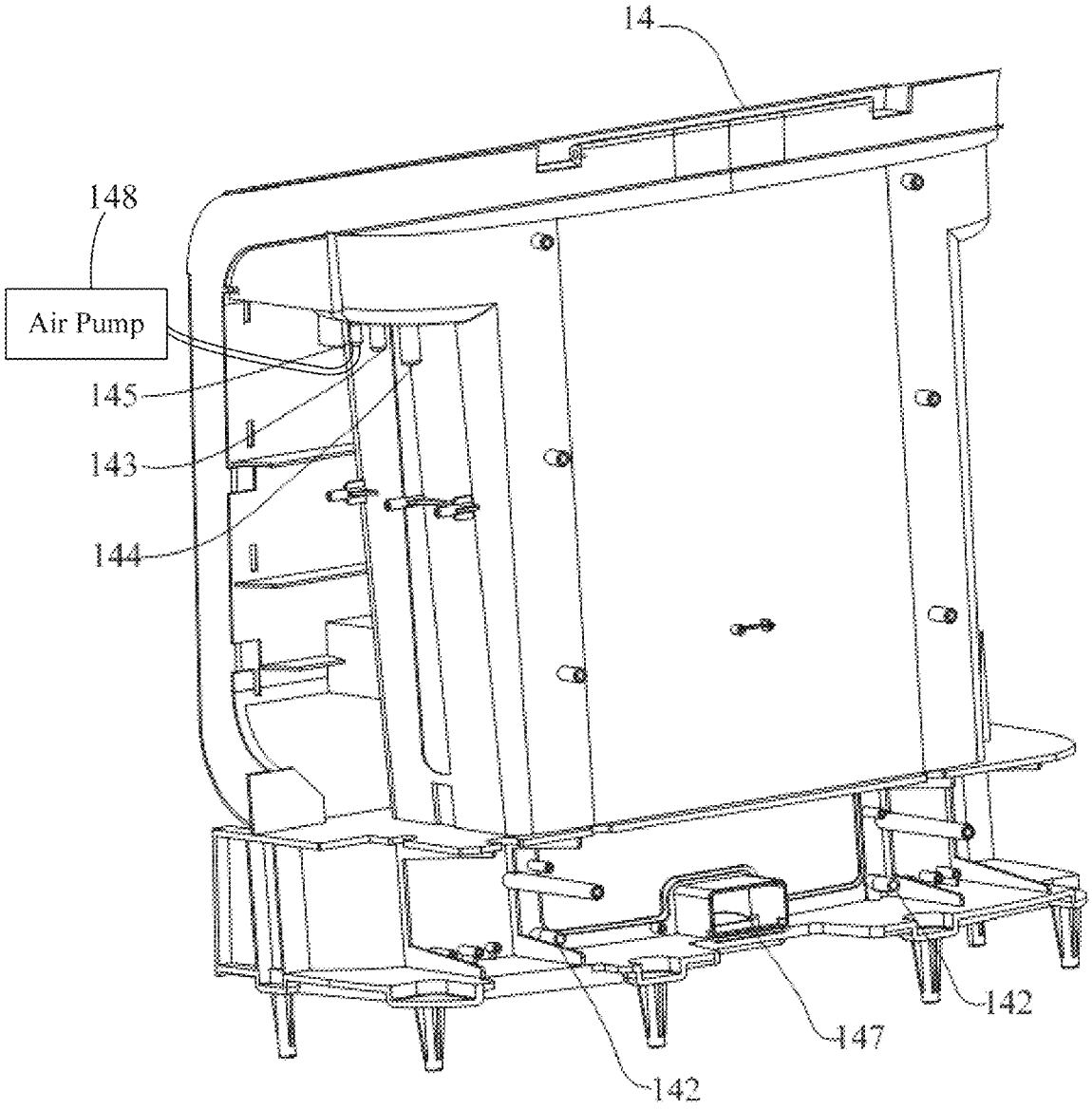
FIG. 4 is a schematic structural view of an embodiment of a liquid tank bracket in FIG. 1.
Figure 5:
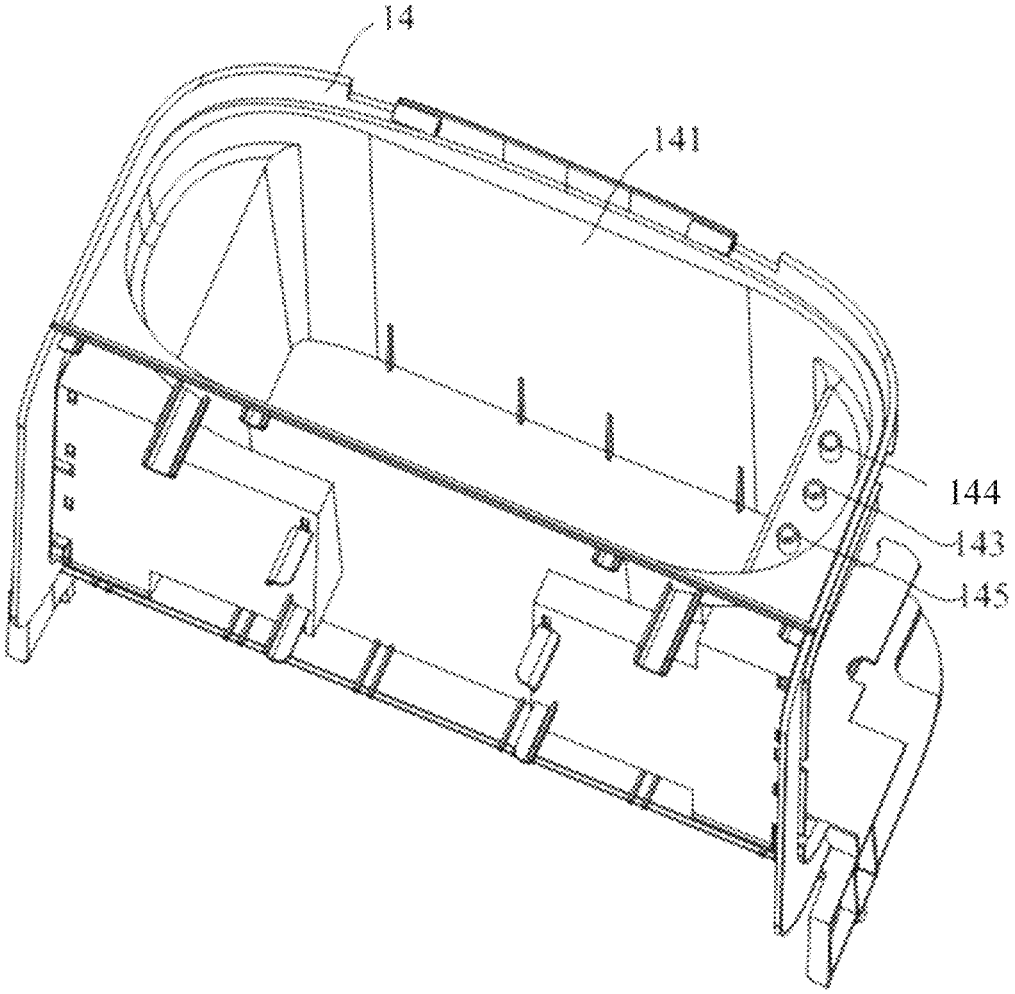
FIG. 5 is a schematic structural view of the liquid tank bracket in FIG. 4 from another perspective.

Further, referring to FIG. 4 and FIG. 5 together, the liquid tank bracket 14 is provided thereon with a first cleaning liquid pipe connection port 142 and a second cleaning liquid pipe connection port 143. The first cleaning liquid pipe connection port 142 is in communication with the liquid applicating port 11, and the first cleaning liquid pipe connection port 142 is in communication with the second cleaning liquid pipe connection port 143 through a pipeline. The second liquid storage structure 40 defines a third cleaning liquid pipe connection port 41, and the third cleaning liquid pipe connection port 41 is in communication with the second cleaning liquid pipe connection port 143 through a pipeline. The first liquid storage structure 30 defines a fourth cleaning liquid pipe connection port 31, and the fourth cleaning liquid pipe connection port 31 is in communication with the third cleaning liquid pipe connection port 41 through a pipeline.

The liquid applicating port 11, the first cleaning liquid pipe connection port 142, the second cleaning liquid pipe connection port 143, the third cleaning liquid pipe connection port 41 and the fourth cleaning liquid pipe connection port 31 form a cleaning liquid supply channel. As compared to the case where the first liquid storage structure 30 is directly connected to the liquid applicating port 11 through a pipeline, the formation of cleaning liquid pipe connection ports connected with the pipelines on the liquid tank bracket 14, the first liquid storage structure 30 and the second liquid storage structure 40 may make the liquid system of the cleaning base station 100 more stable and the pipelines more orderly.

Figure 6:
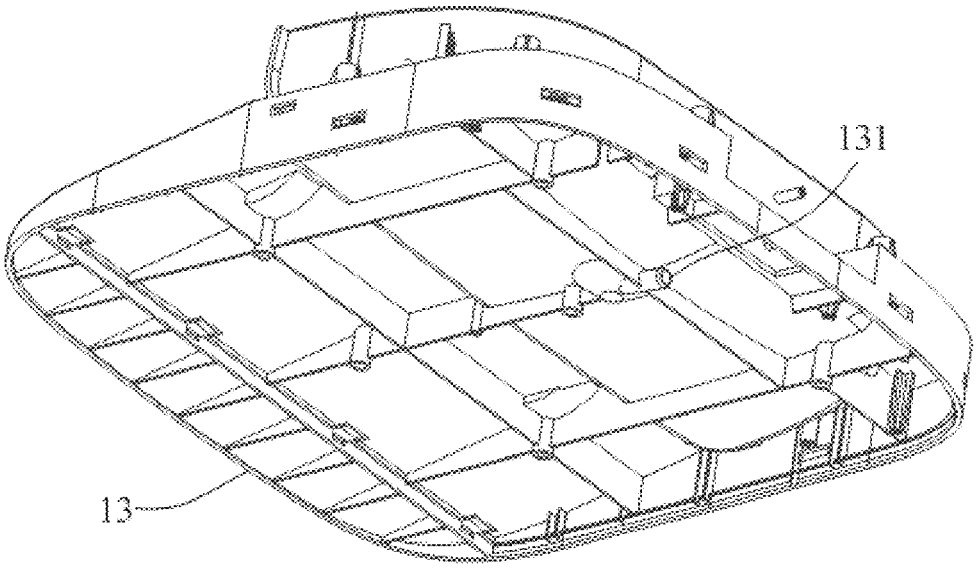
FIG. 6 is a schematic structural view of an embodiment of a chassis assembly in FIG. 1.

Referring to FIG. 6 together, the chassis assembly 13 defines a first sewage pipe connection port 131 communicated with the sewage suction outlet 12, the liquid tank bracket 14 further defines a second sewage pipe connection port 144, and the second liquid storage structure 40 defines a third sewage pipe connection port 42. The first sewage pipe connection port 131 is in communication with the second sewage pipe connection port 144 through a pipeline, and the second sewage pipe connection port 144 is in communication with the third sewage pipe connection port 42 through a pipeline.

The sewage suction outlet 12, the first sewage pipe connection port 131, the second sewage pipe connection port 144 and the third sewage pipe connection port 42 form a sewage recycle channel. As compared to the case where the second liquid storage structure 40 is directly connected to the sewage suction outlet 12 through a pipeline, the formation of the sewage pipe connection ports connected with the pipelines on the chassis assembly 13, the liquid tank bracket 14, and the second liquid storage structure 40 may further make the liquid system of the cleaning base station 100 more stable and the pipelines more orderly.

In order to ensure that the sewage can be quickly pumped into the second liquid storage structure 40, the second liquid storage structure 40 defines a first air exhaust port 43, and the liquid tank bracket 14 defines a second air exhaust port 145 which is in communication with the first air exhaust port 43 via a pipeline. The cleaning base station 100 further includes an air pump 148 fixed on the liquid tank bracket 14, and the air pump 148 is in pneumatic communication with the second air exhaust port 145 via a pipeline.

A negative pressure may be generated inside the second liquid storage structure 40 by pumping out the air from the second liquid storage structure 40 through the air pump 148. In this way, a suction force for sucking sewage is formed at the sewage suction outlet 12 that is in communication with the second liquid storage structure 40, thereby accelerating the recycle of sewage.

In order to improve the structural integrity of the cleaning base station 100, the liquid applicating port 11 may be integrated on the liquid tank bracket 14 and defined at the bottom part of the liquid tank bracket 14. Specifically, referring to FIG. 7, the bottom part of the liquid tank bracket 14 is concavely provided with a drainage groove 146 that is in communication with the first liquid storage structure 30. The base station body 10 further includes a drainage member 15 configured to cover the opening of the drainage groove 146, and an opening penetrating the drainage member 15 is in communication with the drainage groove 146 and forms the liquid applicating port 11.

The drainage member 15 may be provided in many types of structures. For example, the drainage member 15 may be provided in a plate-like structure, a groove-like structure, or other types of structures, and this is not specifically limited herein. The drainage member 15 may be connected with the liquid tank bracket 14 in many ways. For example, the drainage member 15 may be fixedly connected with the liquid tank bracket 14 by bonding, screwing, plugging and other ways. In some embodiments, the drainage member 15 is plugged into the drainage groove 146 of the liquid tank bracket 14, which features convenient and quick disassembly and assembly and facilitates the assembly of the drainage member 15 with the liquid tank bracket 14.

It shall be noted that, if part of the chassis assembly 13 below the cleaning space 102 is at a flat surface, the flow of liquid on the flat surface is uncertain, and if the cleaning member of the cleaning robot is in a rotating state when it is cleaning, then the cleaning liquid is likely to be thrown out and thus affects the recycle of sewage.

Figure 7:
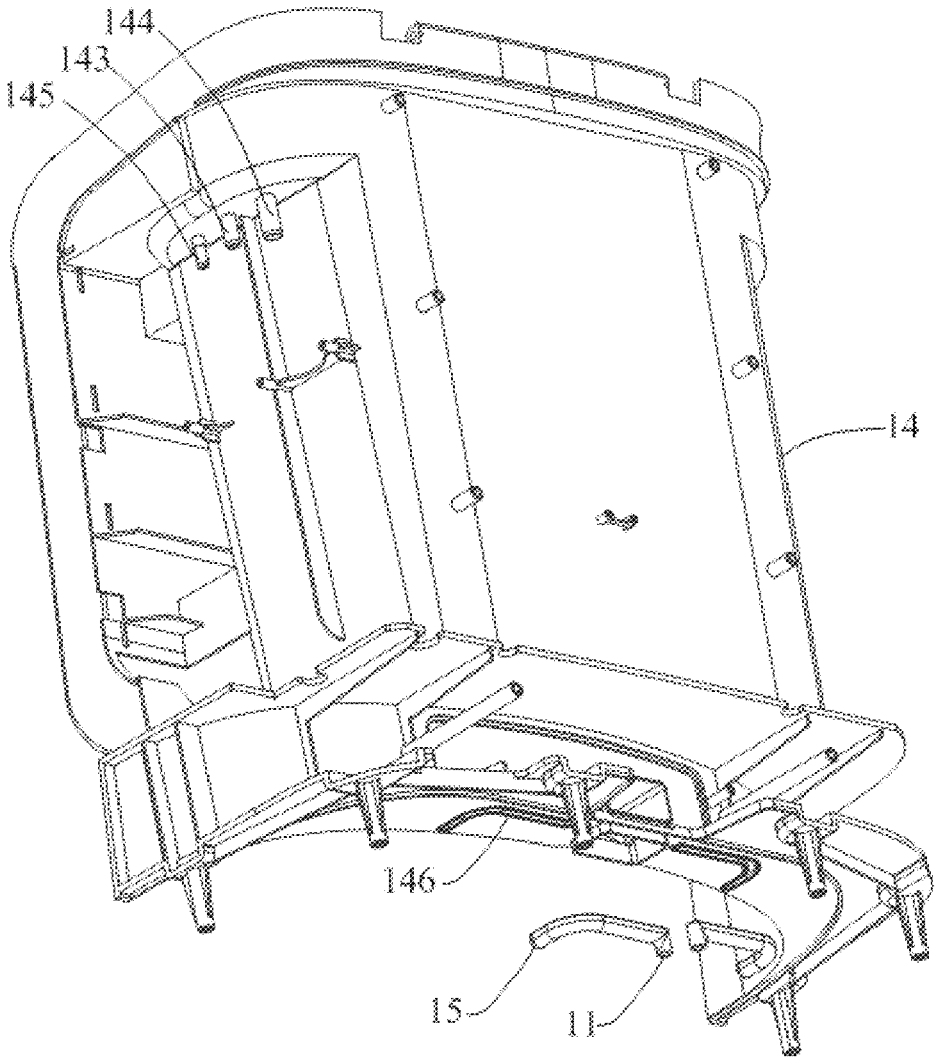
FIG. 7 is an exploded schematic view of the liquid tank bracket and a drainage member in FIG. 1.
Figure 8:
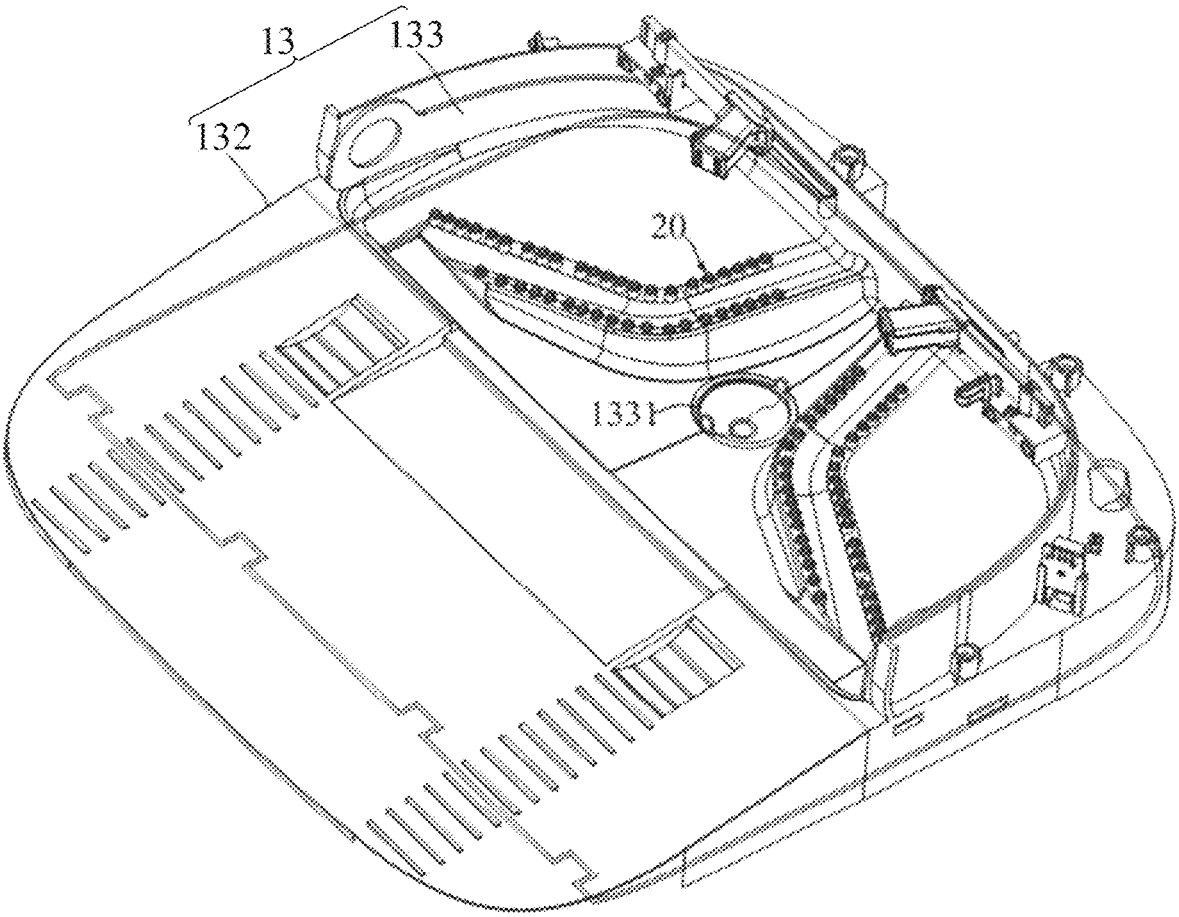
FIG. 8 is a schematic structural view of another embodiment of the chassis assembly in FIG. 1.
Figure 9:
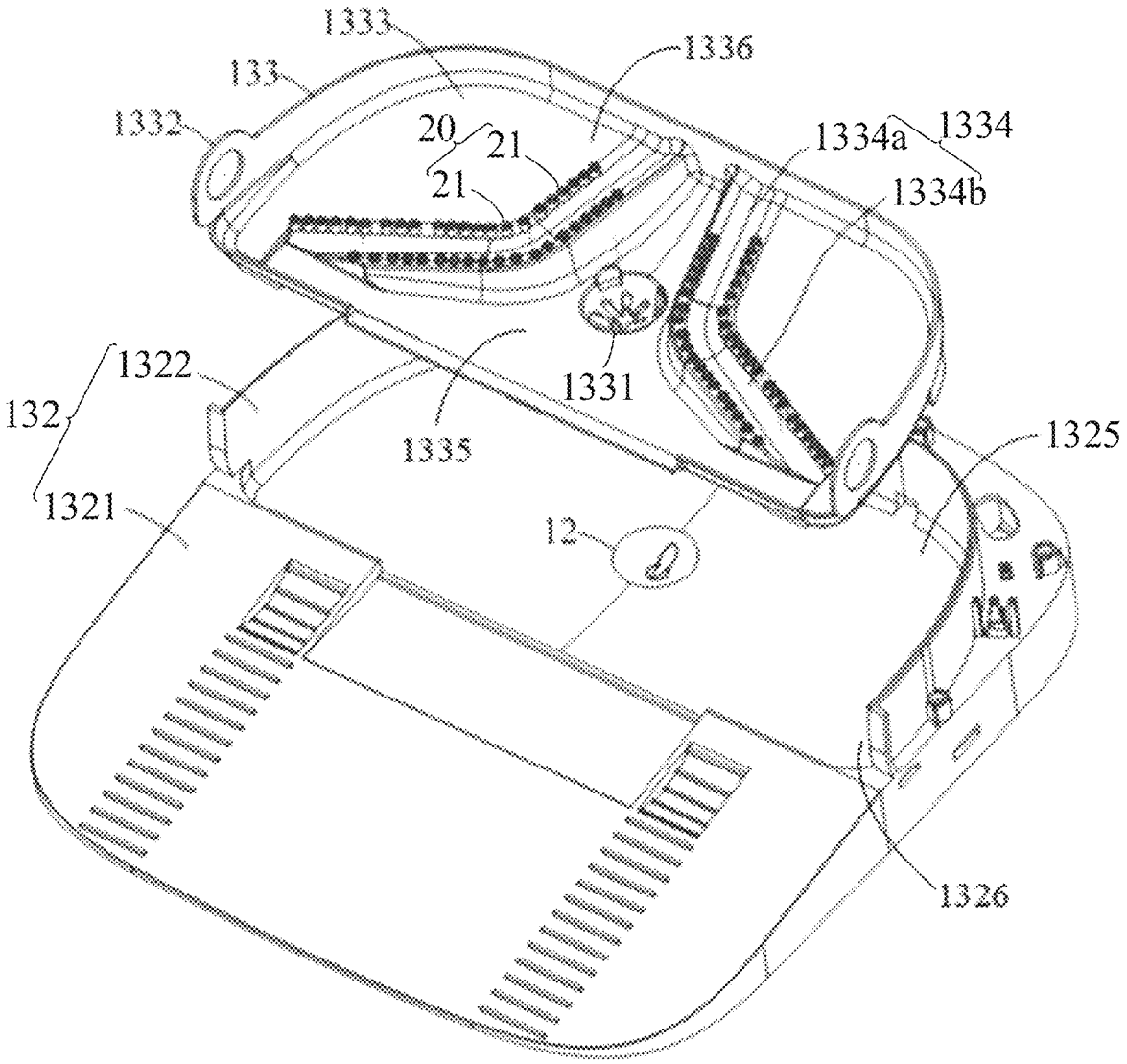
FIG. 9 is an exploded view of the chassis assembly in FIG. 8.

Based on the above problems, referring to FIG. 1, FIG. 7, FIG. Band FIG. 9,the chassis assembly 13 includes a chassis 132 and a cleaning sink 133. The cleaning sink 133 is located below the cleaning space 102, and is detachably mounted on the chassis 132. The sewage suction outlet 12 is arranged on the chassis 132, the cleaning sink 133 is provided with a sewage outlet 1331 communicated with the sewage suction outlet 12, and the cleaning structure 20 is arranged in the cleaning sink 133.

When the cleaning member of the cleaning robot is placed at the cleaning space 102, the cleaning member of the cleaning robot may extend into the cleaning sink 133. This arrangement can not only prevent sewage from flowing everywhere, but also facilitate centralized recycle of sewage, and it can also effectively block the cleaning liquid or sewage from being thrown out by the cleaning member of the cleaning robot. In addition, the cleaning sink 133 is detachably connected with the chassis 132, such that it is convenient to remove the cleaning sink 133 from the chassis 132, thereby facilitating cleaning of the cleaning sink 133.

It shall be said that, the chassis 132 may be connected with the cleaning sink 133 in many ways. For example, the chassis 132 may be connected with the cleaning sink 133 by buckle connection, by magnetic component connection or by other ways, and this is not listed herein.

In some embodiments of the present disclosure, the chassis 132 includes a bottom plate 1321 and a limiting plate 1322 arranged on the upper surface of the bottom plate 1321, the limiting plate 1322 and the bottom plate 1321 cooperatively define an accommodating space 1325 with an open upper end, and the limiting plate 1322 is partially provided with a penetrating opening in a horizontal direction to form an entrance 1326 in communication with the accommodating space 1325, the cleaning sink 133 is installed in the accommodating space 1325, two opposite sides of the cleaning sink 133 adjacent to the penetrating opening are both provided with two lugs 1332, and the two lugs 1332 respectively abut against the corresponding sides of the limiting plate 1322.

When the cleaning sink 133 is assembled into the accommodating space 1325, the bottom part of the cleaning sink 133 abuts against the bottom plate 1321, and the position of the cleaning sink 133 is limited by the limiting plate 1322 in the horizontal direction. At the same time, the two lugs 1332 on the cleaning sink 133 are all equivalent to elastic structures, and the two lugs 1332 respectively abut against the corresponding sides of the limiting plate 1322. In this way, the two lugs 1332 tend to move towards each other, such that the side end of the cleaning sink 133 that is adjacent to the lug 1332 is positioned and thus the cleaning sink 133 is fixed on the chassis 132.

It shall be noted that, the horizontal cross-sectional shape of the cleaning sink 133 may match with the horizontal cross-sectional shape of the accommodating space 1325, such that when the cleaning sink 133 is assembled into the accommodating space 1325, each place on the outer wall of the cleaning sink 133 can contact with the limiting plate 1322, thereby making the connection between the cleaning sink 133 and the chassis 132 more stable.

Considering that the cleaning member of the cleaning robot needs to rotate when cleaning the floor, the cleaning member of the cleaning robot may also move relative to the cleaning structure 20 by self-rotation during cleaning. In view of this, the cleaning structure 20 may be formed by a plurality of protruding portions 21 arranged in the cleaning sink 133, and the plurality of protruding portions 21 extend from the bottom part of the cleaning sink 133 towards the opening of the cleaning sink 133.

When the cleaning robot is parked at the cleaning space 102, the cleaning member of the cleaning robot is in contact with the plurality of protruding portions 21, and there is a certain amount of interference between the cleaning member of the cleaning robot and the plurality of protruding portions 21. In this way, the plurality of protruding portions 21 can fully scrape the cleaning member of the cleaning robot after the cleaning member of the cleaning robot is wet, and thus the cleaning member of the cleaning robot can be cleaned more thoroughly.

Furthermore, the plurality of protruding portions 21 are arranged at linear intervals, and the interval between two adjacent protruding portions 21 is set to be less than or equal to the outer diameter of the protruding portions 21, the plurality of protruding portions 21 are respectively arranged on a plurality of concentric circles arranged at intervals from inside to outside, each of the protruding portions 21 intersects with or is tangent to the concentric circles on the inner and outer sides, and one protruding column 21 among the plurality of protruding portions 21 is corresponding to the center of the cleaning member of the cleaning robot in position. With this arrangement, it can be ensured that the collection of the cleaning areas of the plurality of protruding portions 21 can cover the cleaning member of the entire cleaning robot.

It shall be noted that, the plurality of protruding portions 21 may be arranged at straight linear intervals, the plurality of protruding portions 21 may be arranged in a broken line, or the plurality of protruding portions 21 may be arranged in a wavy line. The way in which the plurality of protruding portions 21 are arranged is not specifically limited herein.

Further, the cleaning sink 133 includes a sewage discharge area 1335 and a cleaning area 1336 which are in communication with each other, the bottom wall of the cleaning area 1336 is positioned higher than the bottom wall of the sewage discharge area 1335, the bottom wall of the cleaning area 1336 protrudes upward to form a liquid storage surface 1333, and the plurality of protruding portions 21 are all arranged on the liquid storage surface 1333.

It shall be noted that, the liquid storage surface 1333 may be a flat surface, a concave curved surface, the liquid storage surface 1333 may also be formed by splicing a flat surface and a curved surface, or may be other types of surfaces, and this is not listed herein.

The liquid storage surface 1333 may be formed by inclining part of the bottom wall of the cleaning area 1336 in the up-down direction, or the liquid storage surface 1333 may be formed by inclining the whole bottom wall of the cleaning area 1336 in the up-down direction. In some embodiments, the liquid storage surface 1333 is formed by inclining the whole bottom wall of the cleaning area 1336 in the up-down direction, such that the flow direction of the cleaning liquid in the cleaning area 1336 may be determined.

When the cleaning member of the cleaning robot is placed at the cleaning space 102, the cleaning member of the cleaning robot extends into the cleaning sink 133 and contacts with the liquid storage surface 1333 and the plurality of protruding portions 21 arranged on the liquid storage surface 1333, and the cleaning liquid flows downward from the liquid applicating port 11 to the liquid storage surface 1333. When the cleaning member of the cleaning robot rotates, it can not only throw out the cleaning liquid on the liquid storage surface 1333, but also throw out the cleaning liquid adsorbed by itself. The cleaning liquid thrown out by the cleaning member of the cleaning robot is temporarily stored on the liquid storage surface 1333, such that it can be ensured that there is enough cleaning liquid on the liquid storage surface 1333, thereby achieving the effect of soaking the cleaning member of the cleaning robot, and further making the cleaning member of the cleaning robot have sufficient cleaning liquid.

In addition, since the liquid storage surface 1333 is higher than the bottom wall of the sewage discharge area 1335, the flow direction of the cleaning liquid in the cleaning sink 133 is determined, and the cleaning liquid can only flow from the cleaning area 1336 to the sewage discharge area 1335. In this way, the problem that the cleaning member of the cleaning robot will get dirty again due to the backflow of the sewage is avoided, thereby ensuring the cleaning effect of the cleaning member of the cleaning robot.

Furthermore, the liquid storage surface 1333 is obliquely arranged from the rear side of the cleaning base station 100 toward the front side of the cleaning base station 100. With this arrangement, the cleaning liquid that has washed the cleaning member of the cleaning robot may flow from top to bottom along the liquid storage surface 1333, such that dirt such as dust, silt or the like washed from the cleaning member of the cleaning robot may be washed away together, thereby ensuring that the cleaning liquid on the upper side of the liquid storage surface 1333 is always clean, and further facilitating the cleaning of the cleaning member of the cleaning robot.

Further, the liquid storage surface 1333 is concavely provided thereon with a liquid storage groove 1334, and the liquid storage groove 1334 includes a first liquid storage section 1334*a* and a second liquid storage section 1334*b*. The first liquid storage section 1334*a* extends from the upper side of the liquid storage surface 1333 to the lower side of the liquid storage surface 1333, the second liquid storage section 1334*b* is located below the first liquid storage section 1334*a* and extends in the horizontal direction, one end of the second liquid storage section 1334*b* is in communication with one end of the second liquid storage section 1334*b*, and the plurality of protruding portions 21 are arranged at intervals along the extension direction of the liquid storage groove 1334 and located at an edge of the liquid storage groove 1334.

The cleaning liquid flows down into the first liquid storage section 1334*a* through the liquid applicating port 11 and finally enters the sewage discharge area 1335 through the second liquid storage section 1334*b*. The arrangement of the liquid storage groove 1334 may effectively collect the cleaning liquid, such that the position of the cleaning member of the cleaning robot that passes through the first liquid storage section 1334*a* may be fully wet. Meanwhile, it is convenient for the dirt on the cleaning member of the cleaning robot to flow along the liquid storage groove 1334 and be discharged into the sewage discharge area 1335.

When part of the cleaning member of the cleaning robot that extends into the first liquid storage section 1334*a* is rotated out of the first liquid storage section 1334*a*, it can not only adsorb enough cleaning liquid, but also take out the cleaning liquid in the first liquid storage section 1334*a*, such that more cleaning liquid is thrown onto the liquid storage surface 1333. The cleaning liquid on the liquid storage surface 1333 flows downward into the second liquid storage section 1334*b* under its own gravity, the cleaning liquid in the first liquid storage section 1334*a* that is not adsorbed by the cleaning member of the cleaning robot flows into the second liquid storage section 1334*b* along the liquid storage surface 1333, and the confluence of the two cleaning liquid still provides enough cleaning liquid in the second liquid storage section 1334*b*. In this way, the cleaning member of the cleaning robot may be cleaned for the second time when passing through the second liquid storage section 1334*b*. That is, the cleaning member of the cleaning robot may be cleaned twice each time it is rotated by one circle, and this is beneficial for improving the cleaning efficiency of the cleaning base station 100.

The cleaning member of the cleaning robot still contains a lot of cleaning liquid after it has been cleaned, and if the cleaning member of the cleaning robot is naturally air-dried, it will take a long time, and this will easily lead to bacteria breeding in the cleaning member of the cleaning robot. In view of this, referring to FIG. 1 and FIG. 4, the cleaning base station 100 is further provided with a fan 50, and the fan 50 is configured to blow air to the cleaning member of the cleaning robot, so as to accelerate the air to flow around the cleaning member of the cleaning robot, and further accelerate the air drying speed of the cleaning member of the cleaning robot.

Furthermore, an air outlet 147 is defined on one side of the liquid tank bracket 14 that is located in the horizontal direction of the cleaning space 102, and the fan 50 is installed on the liquid tank bracket 14 and in communication with the air outlet 147 through a pipeline. As compared to the technical solution in the prior art that the air outlet 147 and the liquid applicating port 11 are implemented by a common component, the air blown out in this technical solution contains no moisture and provides good air drying effect.

Figure 10:
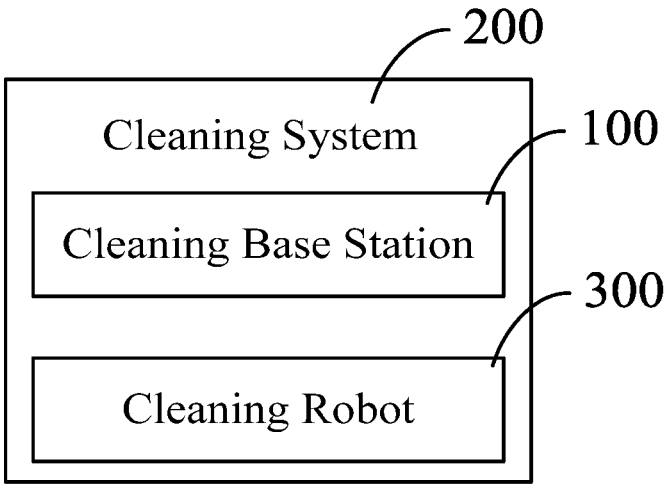
FIG. 10 is a functional block view of a cleaning system according to another embodiment of the present disclosure.

Referring to FIG. 10, another embodiment of the present disclosure further provides a cleaning system 200, the cleaning system 200 includes a cleaning robot 300 and the cleaning base station 100. The cleaning robot 300 is capable of docking with the cleaning base station 100. The cleaning base station 100 is configured to maintain the cleaning robot 300, for example, the cleaning base station 100 is configured to clean a cleaning member of the cleaning robot 300, charge the cleaning robot 300, and add cleaning liquid to the cleaning robot 300. Reference may be made to the above-mentioned embodiments for the specific structure of the cleaning base station 100. As the cleaning system adopts all the technical solutions of all the above-mentioned embodiments, it has at least all the beneficial effects brought by the technical solutions of the above-mentioned embodiments, and this will not be further described herein.

What described above are only the some embodiments of the present disclosure, and are not intended to limit the protective scope claimed in the present disclosure. Any equivalent structures or modifications that are made according to the specification and the attached drawings of the present disclosure under the concept of the present disclosure, or any direct/indirect applications of the present disclosure in other related technical fields shall all be included within the scope claimed in the present disclosure.

What is claimed is:

1. A cleaning base station for a cleaning robot, comprising a base station body, a cleaning structure, a first liquid storage structure and a second liquid storage structure;

the base station body defining a cleaning space where the cleaning robot is capable of being parked, and the base station body comprising a liquid applicating port on an upper side of the cleaning space and a sewage suction outlet on a lower side of the cleaning space;

the cleaning structure being installed on the lower side of the cleaning space, and being configured to clean a cleaning member of the cleaning robot;

the first liquid storage structure being in communication with the liquid applicating port, and the second liquid storage structure being in communication with the sewage suction outlet;

wherein the base station body comprises a chassis assembly, the chassis assembly comprises a cleaning area, a bottom wall of the cleaning area protrudes upward to form a liquid storage surface, the liquid storage surface is concave to form a liquid storage groove, the liquid storage groove comprises a first liquid storage section and a second liquid storage section, one end of the first liquid storage section is directly connected to and in communication with one end of the second liquid storage section, the first liquid storage section extends from an upper side of the liquid storage surface to a lower side of the liquid storage surface, the second liquid storage section is located below the first liquid storage section, and cleaning liquid is capable of flowing into the second liquid storage section through the liquid applicating port and the first liquid storage section;

the base station body comprises a liquid tank bracket installed above the chassis assembly, the liquid tank bracket defines an accommodating cavity configured to accommodate the first liquid storage structure and the second liquid storage structure, and the chassis assembly and the liquid tank bracket cooperatively define the cleaning space; the liquid applicating port is arranged at a bottom part of the liquid tank bracket, and the cleaning structure and the sewage suction outlet are arranged on the chassis assembly;

a bottom part of the liquid tank bracket is concavely provided with a drainage groove, the drainage groove is in fluid communication with the first liquid storage structure in a way that allows the cleaning liquid to flow from the first liquid storage structure to the drainage groove, and the base station body further comprises a drainage member, the drainage member is configured to cover the drainage groove, and an opening penetrating the drainage member is in fluid communication with the drainage groove and forms the liquid applicating port.

2. The cleaning base station of claim 1, wherein the first liquid storage structure is a flexible liquid storage bag, and the first liquid storage structure is installed inside the second liquid storage structure.

3. The cleaning base station of claim 2, wherein the liquid tank bracket defines a first cleaning liquid pipe connection port and a second cleaning liquid pipe connection port, the first cleaning liquid pipe connection port is in communication with the liquid applicating port, and the first cleaning liquid pipe connection port is in communication with the second cleaning liquid pipe connection port;

the second liquid storage structure defines a third cleaning liquid pipe connection port which is in communication with the second cleaning liquid pipe connection port;

the first liquid storage structure defines a fourth cleaning liquid pipe connection port, and the fourth cleaning liquid pipe connection port is in communication with the third cleaning liquid pipe connection port.

4. The cleaning base station of claim 1, wherein the second liquid storage structure defines a first air exhaust port, the liquid tank bracket defines a second air exhaust port which is in communication with the first air exhaust port, the cleaning base station further comprises an air pump fixed on the liquid tank bracket, and the air pump is in pneumatic communication with the second air exhaust port.

5. The cleaning base station of claim 1, wherein the chassis assembly defines a first sewage pipe connection port in communication with the sewage suction outlet, the liquid tank bracket defines a second sewage pipe connection port, the second liquid storage structure defines a third sewage pipe connection port, the first sewage pipe connection port is in communication with the second sewage pipe connection port, and the second sewage pipe connection port is in communication with the third sewage pipe connection port.

6. The cleaning base station of claim 1, wherein the chassis assembly comprises a chassis and a cleaning sink detachably mounted on the chassis, the sewage suction outlet is defined on the chassis, the cleaning sink defines a sewage outlet in communication with the sewage suction outlet, and the cleaning structure is arranged in the cleaning sink.

7. The cleaning base station of claim 6, wherein the chassis comprises a bottom plate and a limiting plate arranged on an upper surface of the bottom plate, the limiting plate and the bottom plate cooperatively define an accommodating space, the limiting plate is partially provided with a penetrating opening in a horizontal direction to form an entrance in communication with the accommodating space, the cleaning sink is installed in the accommodating space, the cleaning sink comprises two lugs, the two lugs are located at two opposite sides of the cleaning sink adjacent to the penetrating opening, and the two lugs respectively abut against two corresponding sides of the limiting plate.

8. The cleaning base station of claim 7, wherein a horizontal cross-sectional shape of the cleaning sink matches with a horizontal cross-sectional shape of the accommodating space, and an outer wall of the cleaning sink contacts with the limiting plate.

9. The cleaning base station of claim 6, wherein the cleaning structure comprises a plurality of protruding portions protruding from a bottom part of the cleaning sink, and the protruding portions are configured to clean the cleaning member of the cleaning robot when the cleaning member of the cleaning robot rotates.

10. The cleaning base station of claim 9, wherein the cleaning sink comprises a sewage discharge area, the sewage discharge area and the cleaning area are in communication with each other, the bottom wall of the cleaning area is positioned higher than a bottom wall of the sewage discharge area, and the protruding portions are all arranged on the liquid storage surface.

11. The cleaning base station of claim 10, wherein the liquid storage surface is obliquely arranged from a rear side of the cleaning base station toward a front side of the cleaning base station.

12. The cleaning base station of claim 10, wherein the protruding portions are arranged at linear intervals, the interval between two adjacent protruding portions is set to be less than or equal to an outer diameter of the protruding portions, the protruding portions are respectively arranged on a plurality of concentric circles arranged at intervals from inside to outside, each of the protruding portions intersects with or is tangent to the concentric circles on the inner and outer sides, and one protruding column among the protruding portions is corresponding to a center of the cleaning member of the cleaning robot in position.

13. The cleaning base station of claim 10, wherein the second liquid storage section extends along a horizontal direction, the protruding portions are arranged at intervals along two opposite edges of each of the first liquid storage section and the second liquid storage section, and some of the protruding portions arranged along one of the two edges are spaced apart from other protruding portions arranged along the other of the two edges.

14. The cleaning base station of claim 1, wherein the liquid tank bracket defines an air outlet, the air outlet is located at one side of the liquid tank bracket in a horizontal direction of the cleaning space, and the cleaning base station further comprises a fan which is in communication with the air outlet.

15. A cleaning system, comprising a cleaning robot and the cleaning base station of claim 1, the cleaning robot capable of docking with the cleaning base station, and the cleaning base station configured to maintain the cleaning robot.

16. The cleaning base station of claim 1, wherein the cleaning structure comprises a plurality of protruding portions, the protruding portions are arranged at intervals along two opposite edges of each of the first liquid storage section and the second liquid storage section, some of the protruding portions arranged along one of the two edges are in a line, other protruding portions arranged along the other of the two edges are in another line, and the two lines are spaced apart from and opposite to each other.

17. The cleaning base station of claim 1, wherein the cleaning structure comprises a plurality of protruding portions, the protruding portions are arranged at intervals along two opposite edges of each of the first liquid storage section and the second liquid storage section, and an interval between two adjacent protruding portions is set to be less than or equal to an outer diameter of the protruding portions.

* * * * *